US005335396A

United States Patent [19]

Dolan

[11] Patent Number: 5,335,396

[45] Date of Patent: Aug. 9, 1994

[54] DOOR STOP

[76] Inventor: Randall S. Dolan, 1607 Fourth Ave. SE., Austin, Minn. 55912

[21] Appl. No.: 101,967

[22] Filed: Aug. 4, 1993

Related U.S. Application Data

[63] Continuation-in-part of Ser. No. 963,080, Oct. 19, 1992, abandoned.

[51] Int. Cl.[5] ..... E05F 5/02

[52] U.S. Cl. ..... 16/82; 24/543; 292/262

[58] Field of Search ..... 16/82, DIG. 17, 84, 16/DIG. 7; 24/543; 292/262, 338

[56] References Cited

U.S. PATENT DOCUMENTS

| | | | |
|---|---|---|---|
| 4,042,265 | 8/1977 | Chezem | 292/262 |
| 4,807,855 | 2/1989 | Schuitema | 292/338 |
| 4,824,082 | 4/1989 | Schaupp | 292/338 |
| 5,024,303 | 6/1991 | Kosloff | 292/262 |

*Primary Examiner*—P. Austin Bradley
*Assistant Examiner*—Chuck Y. Mah
*Attorney, Agent, or Firm*—William J. Ryan

[57] ABSTRACT

A stop is provided for maintaining a closing mechanism having a rod operable within a cylinder in an open position. The stop comprises a body portion having a central, longitudinally extending bore. The body portion is positionable on the rod by snapping the rod through a relatively smaller passage defined in the body portion into the bore, which is slightly larger in diameter than the rod. A thumbscrew is provided extending through the body portion into the bore so as to frictionally secure the stop at the desired location along the rod. A closure flap is provided for closing the passage so as to prevent accidental detachment of the body portion from the rod once in place.

1 Claim, 2 Drawing Sheets

DOOR STOP

This is a continuation in-part of my co-pending application, Ser. No. 07/963,080 filed Oct. 19, 1992, entitled "Replacement Door Stopper", now abandoned.

BACKGROUND OF THE INVENTION

1. Field of the Invention

The present invention relates to a detachable stop useful in conjunction with door closing mechanisms having a piston/rod combination operating within a cylinder. The stop is positionable along the piston rod exteriorly of the cylinder at a selected point to prevent the rod from being drawn in to the cylinder, thereby maintaining the door in a generally open or partially open position.

2. Description Of the Prior Art

The use of door closing mechanisms having a rod and associated piston operating within a cylinder is well known. For instance, in residential applications, it is well known to connect such mechanism between the door and its frame to act as a shock absorber or dampener against the action of a closing force such as a spring or a partial vacuum within the cylinder. Such mechanisms have also been used in many other applications such as hatchback doors on motor vehicles and even unrelated uses such as closure devices on umbrellas.

It has been known to provide different types of stops in conjunction with such closing mechanisms which allow the door to be closed only partially, thereby temporarily maintaining the door in the desired position against the closing force. One of the more common types of prior art devices consists of a stop washer mounted on the piston rod. The washer is wedged between the rod and the cylinder to prevent the rod from being drawn in to the cylinder.

Another type of the prior art is shown in U.S. Pat. No. 1,892,811 which utilizes a stop comprising a collar positioned around the rod exteriorly of the cylinder, with a thumbscrew that can be tighten to fix the collar at the desired location along the cylinder An alternative embodiment comprises a lever in place of a collar, which acts in much the same fashion as the conventional stop washer. One of the problems with this type of device is that the stop must be put in position on the rod when the closing mechanism is installed. Consequently, each closing mechanism requires its own stopper.

Another example of the prior art is shown in U.S. Pat. No. 5,024,303 which discloses a locking mechanism for hatchbacks. In this instance, the locking mechanism comprises a body having two portions hinged together and defining a central aperture, which is positionable around the rod at a desired location. The two portions of the body member are secured by fastening means such as a hinge pin. Again, the body member may be locked in the desired position by a thumbscrew. The type of arrangement taught in this patent, however, is not easily detachable once in place. Consequently, each locking mechanism is generally operable only in conjunction with the closing mechanism on which it is originally installed.

One drawback of all of the prior art devices is that if the original stop should fail for any reason, the whole door shock must be replaced or at least disassembled to remove the failed stop and add a replacement stop.

SUMMARY OF THE INVENTION

It is one object of the present invention to provide a door stop which can act as a replacement stop for use on existing door closing mechanisms of the type described.

It is another object of the present invention to provide a locking mechanism or stop useful in conjunction with door closing mechanisms comprising a piston/rod and similar combination that is readily attachable to and/or detachable from engagement with the piston rod so that the stopper can be easily used in conjunction with different locking mechanisms.

To those ends, a door stop is provided which comprises an elastic, generally cylindrical body having a central longitudinally extending bore. The body is split longitudinally in such a fashion that it can be snapped on to and out of engagement with the rod of the described type of door closing mechanism. The aperture size is slightly greater than the diameter of the diameter of the rod such that the stop can be slid along the length of the rod and selectively positioned at any desired location thereon. Means are provided for opening and closing the split in the body, such as a cover attached to one side of the split by a living hinge and selectively attachable to the body on the opposite side of the split, to secure the body to the rod. A thumbscrew extends transversely through the body and can be tightened to secure the stop in a locked position at any desired location along the rod.

DETAILED DESCRIPTION OF THE PREFERRED EMBODIMENT

Figure 1:
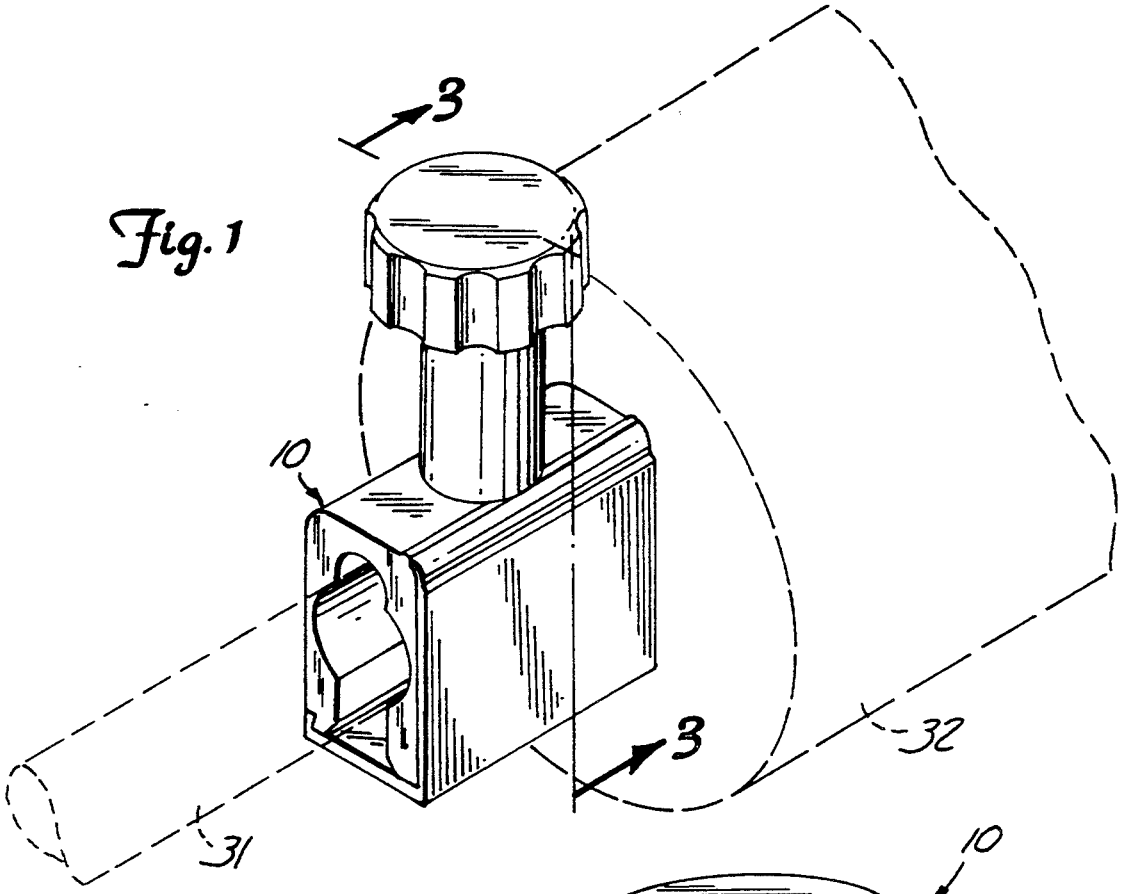
FIG. 1 is a perspective view of a door stop according to the present invention in closed position showing the rod and cylinder of the door closing mechanism in dashed lines.
Figure 2:
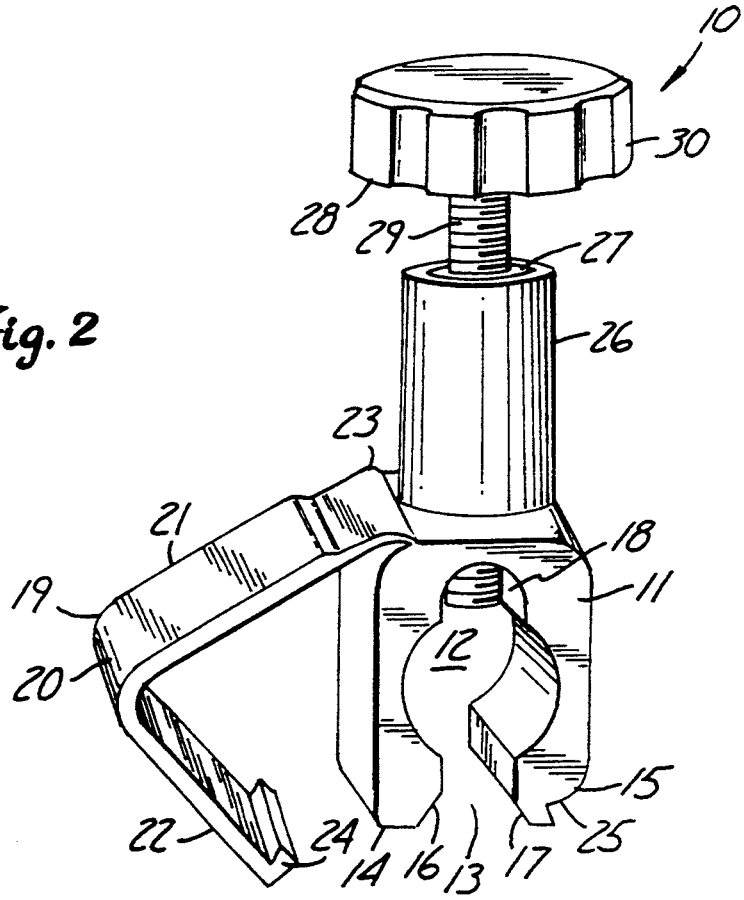
FIG. 2 is an elevational view showing a door stop according to the present invention.
Figure 3:
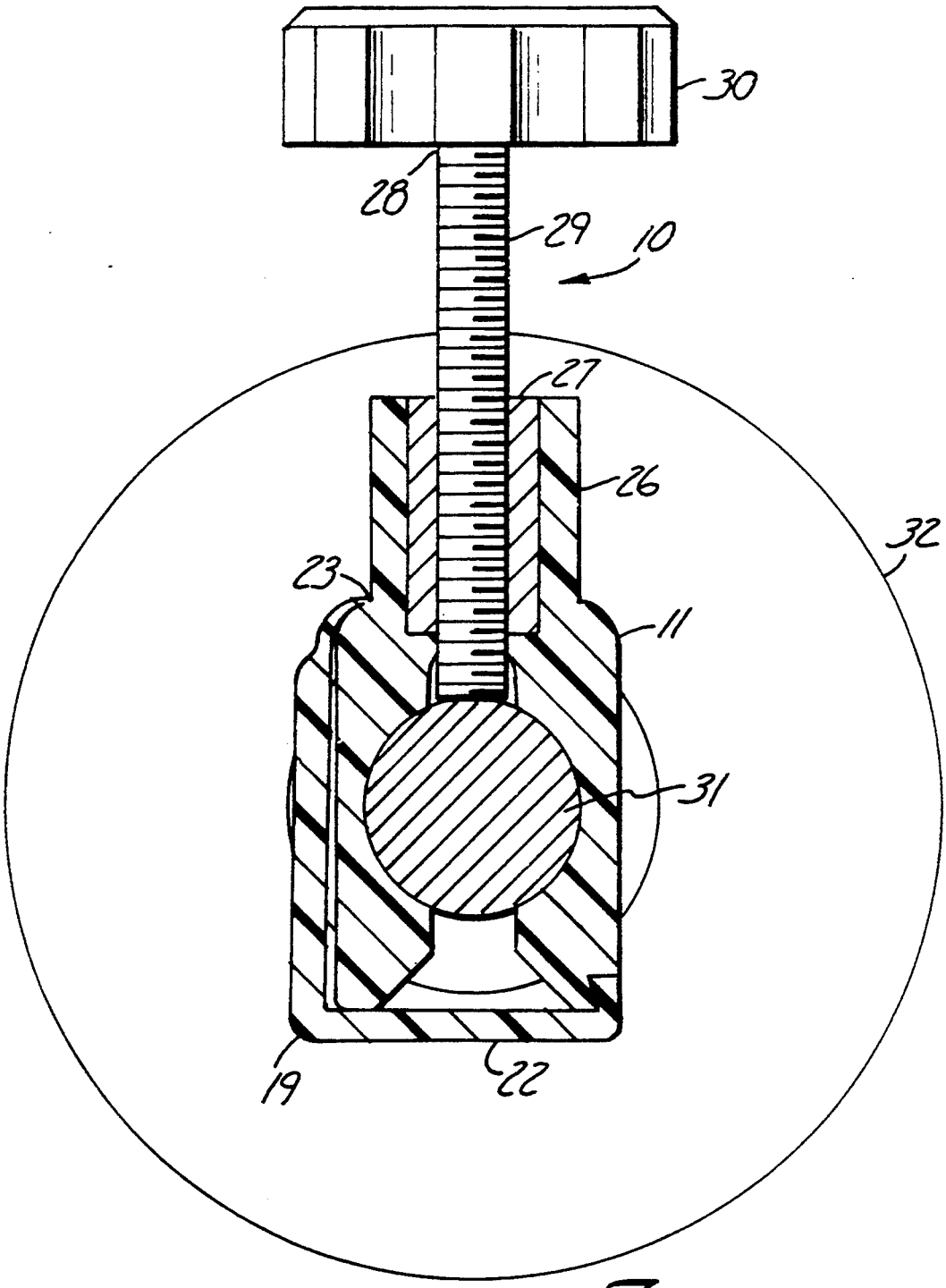
FIG. 3 is a side sectional view of a door Stop according to the present invention taken generally along the line 3—3 of FIG. 1.

Referring to the drawing, wherein like numerals represent like elements throughout the several views, there is provided a stop generally designated by the numeral 10. As shown in FIG. 1, the stop 10 is used in conjunction with a door closing mechanism having a rod 31 operating within a cylinder 32. The stop 10 operates by preventing the rod 31 from being drawn in to the cylinder 32 past the point at which the stop 10 is placed.

The stop 10 comprises a body portion 11 defining a central, longitudinally extending generally cylindrical bore 12. One side of the body portion 11 is split as at 13 so as to define spaced shoulders 14, 15 in the body portion 11. The inwardly facing edges 16, 17 of shoulders 14, 15, respectively, are bevelled as shown.

The bore 12 is sized so as to be slightly greater in diameter than the diameter of the rod 31 used in the door dosing mechanism, typically on the order of $\frac{1}{4}$ inch-5/16 inch. The width of the split 13 is less than the diameter of the rod 31. The body portion 11 is comprised of an elastic material such as plastic such that the body portion 11 may be snapped under pressure on to the door closure rod 31 by passage of the rod 31 through the split 13 and into bore 12. A notch 18 in the body portion 11 may be provided adjacent bore 12 opposite of split 13 to facilitate deformation of the body portion 11 when it is snapped on to rod 31. When snapped on to the rod 31, the body portion 11 can be slid along the rod 31 to any desired position exteriorly of the cylinder 32.

To maintain the body portion 11 securely on the rod 31 once snapped in place, a closure member 19 is provided which may be secured over split 13. The closure member 19 shown in the preferred embodiment consists of a generally "L" shaped flap 20 having a first leg 21 and a second leg 22 extending generally perpendicularly from one end of the first leg 21. The opposite end of the first leg 21 is secured to the body portion 11 as by a living hinge 23 at such a location that the second leg 22 is positionable across split 13. The outer end of leg 22 carries a generally perpendicular, but slightly inwardly projecting lip 24 which may be snapped into engagement with a notch 25 defined in shoulder 15, as shown.

An exterior collar 26 is formed on the body portion 11 oppositely of split 13. The collar 26 has a brass sleeve insert 27 which defines a female threaded bore extending generally perpendicularly through the body portion 11 to bore 12 in which a thumbscrew 28 operates. The thumbscrew 28 has a male threaded portion 29 and a manually graspable cap 30 in the usual fashion.

In operation, the stop 10 is placed on the door closure rod 31 by placing the bevelled edges 16, 17 adjacent the rod 31 and snapping the body portion 11 on to the rod 31 by application of manual pressure. When in place, the closure flap 20 is closed by snapping lip 24 into notch 25 to prevent accidental unsnapping of the stop 10. The stop 10 may be slid along the rod 31 to the desired location and there secured in place by tightening of the thumbscrew 28.

While I have described the preferred embodiment of my invention, other embodiments will be apparent to those of ordinary skill in the art.

What is claimed is:

1. A stop for maintaining a closing mechanism having a rod operable within a cylinder in an open position, comprising:

(a) a body portion having a bore defined therein, said body portion being split so as to defined spaced shoulders each having a bevelled edge providing a passage between said bore and the exterior of said body portion;

(b) a locking member extending from an extension surface opposite of the bevelled edges of said body portion and being operable within said body portion to engage said rod so as to frictionally secure said body portion to said rod; and (c) a closure flap secured to said body portion and being operable across said passage between an open position and a closed position.

* * * * *